US009784411B2

(12) United States Patent
Diggins

(10) Patent No.: US 9,784,411 B2
(45) Date of Patent: Oct. 10, 2017

(54) SYSTEM AND METHOD FOR UNLOADING COMPRESSED NATURAL GAS

(71) Applicant: David A. Diggins, Midland, TX (US)

(72) Inventor: David A. Diggins, Midland, TX (US)

( * ) Notice: Subject to any disclaimer, the term of this patent is extended or adjusted under 35 U.S.C. 154(b) by 137 days.

(21) Appl. No.: 14/677,725

(22) Filed: Apr. 2, 2015

(65) Prior Publication Data

US 2016/0290563 A1 Oct. 6, 2016

(51) Int. Cl.
*B65B 1/20* (2006.01)
*F17C 7/02* (2006.01)
(Continued)

(52) U.S. Cl.
CPC ..... *F17C 7/02* (2013.01); *F17C 5/06* (2013.01); *F17C 7/00* (2013.01); *F17C 2205/0332* (2013.01); *F17C 2205/0338* (2013.01); *F17C 2221/033* (2013.01); *F17C 2223/0123* (2013.01); *F17C 2223/035* (2013.01); *F17C 2223/036* (2013.01); *F17C 2225/0123* (2013.01); *F17C 2225/033* (2013.01); *F17C 2227/03* (2013.01); *F17C 2227/0316* (2013.01); *F17C 2227/0323* (2013.01); *F17C 2227/0332* (2013.01); *F17C 2250/01* (2013.01); *F17C 2250/043* (2013.01); *F17C 2250/0439* (2013.01); *F17C 2250/0631* (2013.01); *F17C 2260/056* (2013.01);
(Continued)

(58) Field of Classification Search
CPC ..... F17C 7/00; F17C 7/02; F17C 5/06; F17C 2205/0332; F17C 2205/0338; F17C 2221/033; F17C 2223/0123; F17C 2223/035; F17C 2223/036; F17C 2225/033; F17C 2225/0123; F17C 2227/03; F17C 2227/0316; F17C 2227/0323; F17C 2227/0332; F17C 2250/01; F17C 2250/043; F17C 2250/0439; F17C 2250/0631; F17C 2260/056; F17C 2270/0134; F17C 2270/0142; F17C 2270/05
See application file for complete search history.

(56) References Cited

U.S. PATENT DOCUMENTS 2,976,695 A * 3/1961 Meade ..... F17C 13/02 62/393
3,407,052 A * 10/1968 Huntress ..... C10K 3/06 48/127.1
(Continued)

*Primary Examiner* — Patrick M Buechner
*Assistant Examiner* — Randall Gruby
(74) *Attorney, Agent, or Firm* — Ross Barnes LLP; Monty L. Ross; Robin L. Barnes

(57) ABSTRACT

A system and method for unloading highly pressurized compressed natural gas from transport vessels by depressurizing the gas through flow lines linking a series of automated flow control valves that lower the gas pressure to a predetermined level, the valves being linked in series with and separated by heat exchangers in which the lower pressure gas flowing through the system is also reheated to a predetermined temperature by a heat exchange medium recirculation system in which the heat exchange medium is reheated by a heat source that can be internal to the system. The use of a minor portion of the depressurized and reheated gas as fuel gas to reheat the heat exchange medium is also disclosed. The subject system can be skid-mounted if desired.

3 Claims, 1 Drawing Sheet

(51) Int. Cl.
*F17C 5/06* (2006.01)
*F17C 7/00* (2006.01)

(52) U.S. Cl.
CPC ..... *F17C 2270/0134* (2013.01); *F17C 2270/0142* (2013.01); *F17C 2270/05* (2013.01)

(56) References Cited

U.S. PATENT DOCUMENTS 3,435,840 A * 4/1969 Clarke ..... F17B 1/12 137/110
3,653,394 A * 4/1972 McJones ..... F04B 41/02 137/114
4,995,234 A * 2/1991 Kooy ..... F01K 25/10 60/648
5,107,906 A * 4/1992 Swenson ..... F17C 9/02 141/11
5,169,295 A * 12/1992 Stogner ..... F04B 9/1174 417/339
5,211,021 A * 5/1993 Pierson ..... F17C 5/02 141/11
5,243,821 A * 9/1993 Schuck ..... F17C 7/04 417/53
5,351,726 A * 10/1994 Diggins ..... F17C 5/06 123/525
5,360,139 A * 11/1994 Goode ..... F17C 5/007 141/18
5,409,046 A * 4/1995 Swenson ..... F17C 9/02 141/11
5,603,360 A 2/1997 Teel
5,628,349 A * 5/1997 Diggins ..... F17C 5/06 141/3
5,676,180 A 10/1997 Teel
5,916,245 A * 6/1999 Tom ..... B01D 53/04 206/0.7
6,032,483 A * 3/2000 Paganessi ..... C01B 7/01 62/620
6,112,528 A * 9/2000 Rigby ..... F17C 7/04 222/3
6,257,017 B1 * 7/2001 Kimble ..... B63B 25/16 62/611
6,415,619 B1 * 7/2002 Bash ..... F25B 5/02 257/E23.098
6,644,039 B2 11/2003 Hughes et al.
6,953,045 B2 10/2005 Enerson
7,144,228 B2 12/2006 Emmer et al.
7,328,726 B2 * 2/2008 Cohen ..... B01F 3/028 141/104
8,281,820 B2 10/2012 White
8,286,675 B2 10/2012 Farese et al.
8,544,296 B2 10/2013 Santos
8,607,830 B2 12/2013 White
8,695,357 B2 * 4/2014 Brook ..... F02M 21/06 62/49.1
8,726,676 B2 * 5/2014 Watts ..... F17C 5/06 62/45.1
8,757,223 B2 * 6/2014 Uemura ..... F17C 5/06 141/197
8,763,565 B2 * 7/2014 Dunn ..... F02M 21/0209 123/27 GE
8,978,715 B2 * 3/2015 Allidieres ..... F17C 5/06 141/1
9,234,627 B2 * 1/2016 Cajiga ..... F17C 1/14
9,279,420 B2 * 3/2016 Moore ..... F04B 27/04
9,385,574 B1 * 7/2016 Xu ..... F03G 6/005
2003/0182947 A1 * 10/2003 Kimble ..... F17C 5/04 62/48.2
2004/0118476 A1 * 6/2004 Borck ..... F17C 5/06 141/4
2005/0274126 A1 * 12/2005 Baudat ..... F17C 5/06 62/50.2
2006/0071016 A1 * 4/2006 Diggins ..... F17C 7/02 222/3
2006/0076076 A1 * 4/2006 Darling ..... F17C 5/02 141/82
2006/0260711 A1 * 11/2006 Fry ..... F17C 5/06 141/94
2007/0079891 A1 * 4/2007 Farese ..... F17C 5/007 141/94
2007/0186564 A1 * 8/2007 Hubbard ..... F17C 3/04 62/50.2
2007/0214807 A1 * 9/2007 Faka ..... F17C 5/06 62/50.2
2007/0271932 A1 * 11/2007 Dutt ..... F17C 9/02 62/50.2
2008/0127654 A1 * 6/2008 Darling ..... F17C 7/02 62/50.2
2010/0213083 A1 * 8/2010 Olander ..... F17C 11/00 206/0.7
2013/0139544 A1 * 6/2013 Mak ..... F25J 1/0025 62/611
2013/0298572 A1 * 11/2013 Mak ..... F17C 9/02 62/47.1
2014/0250921 A1 9/2014 Kang et al.
2015/0020918 A1 1/2015 Macaluso et al.
2015/0047738 A1 * 2/2015 Wilson ..... F17C 13/025 141/1

* cited by examiner

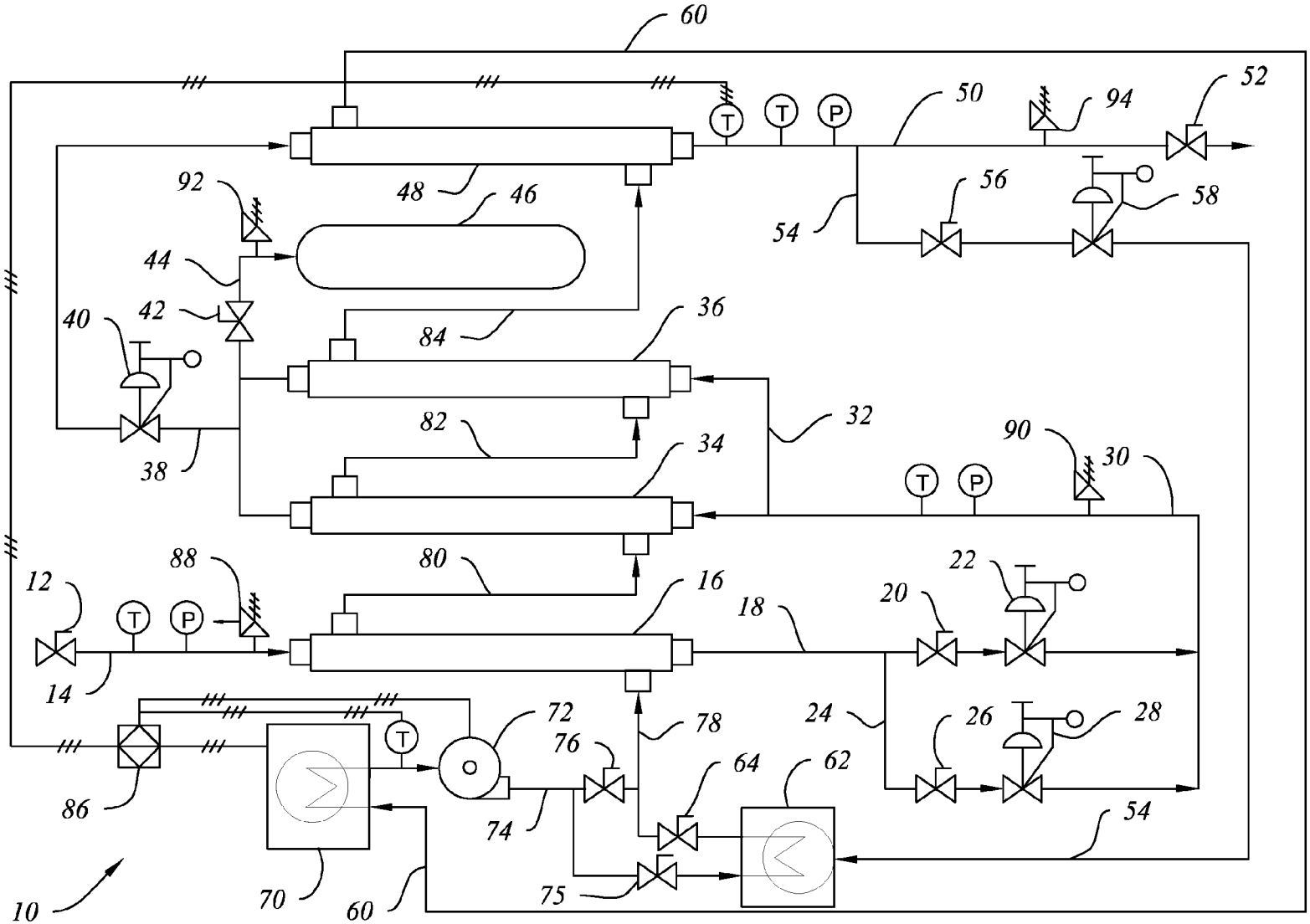
52
58
94
56
50
54
60
P
T
T
46
48
92
44
42
40
38
36
84
32
34
82
90
30
80
16
18
20
22
24
26
28
54
62
64
78
76
72
74
75
70
60
88
P
T
12
14
86
10

SYSTEM AND METHOD FOR UNLOADING COMPRESSED NATURAL GAS

1. FIELD OF THE INVENTION

The subject invention relates to a system and method for unloading pressurized gas, preferably compressed natural gas ("CNG"), from transport tanks in which it is delivered from a source such as a wellhead storage tank to a destination such as a customer, industrial user, or pipeline. More particularly, the invention relates to a system and method for unloading and depressurizing compressed natural gas while automatically controlling the temperature, pressure and flow rate of the delivered gas within acceptable ranges. Another aspect of the invention relates to a system and method for reducing residual gas pressure in a transport tank to a desired minimal level when unloading compressed natural gas. Still another aspect of the invention relates to a method for unloading compressed natural gas that includes diverting a minor portion of the offloaded gas that is discharged from the system of the invention following depressurization for use as low pressure fuel gas to re-heat a recirculating heat exchange medium that is used to heat the transported gas as it cools while being offloaded through the system. The present invention is distinguished from, and is not intended for use with, systems or methods for transporting or delivering liquefied natural gas ("LNG").

2. DESCRIPTION OF RELATED ART

In locations where gas-producing wells are located remotely from pipelines or other industrial use sites, it is often desirable to compress the natural gas and transport it by land, air, rail or sea in tube trailers or in gas transport modules ("GTM") that are well known to those of ordinary skill in the art. In other situations it may be desirable to transport CNG from a pipeline to an industrial customer. Gas pressures in such CNG transport vessels often range from about 3000 to 4200 PSI or more, and typically from about 3250 to 3600 PSI, depending upon parameters such as ambient temperature, fluid composition, vehicular weight limits, and the like. Using conventional unloading systems, operational difficulties are often encountered in unloading CNG from transport tanks into pipelines or during delivery to other industrial customers, particularly when ambient temperatures are well below standard conditions. The economics of pressurized gas transport and delivery are also adversely affected if the amount of gas delivered is insufficient to reduce the residual pressure in the transport vessel to a desired minimum level for return to a gas-loading site.

With conventional CNG delivery systems, an initially high pressure (such as, for example, around 3600 PSI) inside a transport tank drops as the gas passes through a throttling valve at the unloading site. As the remaining lower-pressure gas passes through the valve, the pressure, temperature and flow rate can drop even lower, to undesirably low levels, especially when the ambient temperatures are low as well. Where the delivered CNG is being discharged into gas supply lines to furnaces, boilers, or large internal combustion engines (e.g., those powering locomotives, generators, or the like), the gas flow rate needed to meet the downstream demand is typically measured in standard cubic feet of gas per minute or hour, and can be highly variable, requiring throttling valves in the unloading or delivery equipment to constantly adjust for such variations. In some cases, this can require increasing the flow rate through the discharge line of the delivery system at the same time that the flow rate in the delivery system is being depleted as the transport tank is emptied, which in turn further cools the temperature of the gas discharged through the throttling valves.

Also, when the pressure differential across the throttling valve falls to a level where a significant volume of lower-pressure gas remains inside the tank and cannot be discharged at the required minimum temperature and pressure. The natural gas transporter is then faced with the problem of having to transport a significant volume of gas back to the reloading station, thereby incurring additional transportation charges for a portion of the original natural gas payload that was not deliverable.

Other methods for transporting and unloading CNG or LNG are disclosed, for example, in U.S. Pat. Nos. 5,603,360; 5,676,180; 8,281,820 and 8,607,830. In another known prior application, closed loop regulators have sometimes been used for verifying compressor delivery pressure and power load requirements at steady state flow rates. In the latter case, such gas regulators are typically manually adjusted to control flow rate, pressure and temperature of the delivered gas by recycling a portion of the gas discharged from the compressor at a high discharge pressure of about 4200 PSI to the compressor inlet to directly preheat the inlet gas.

A system and method for unloading CNG and delivering it to an industrial user at an acceptable outlet gas temperature, pressure and flow rate and for reducing the residual pressure level in the transport vessel to a minimal acceptable level under ambient conditions are therefore needed. Such a system and method are disclosed below.

SUMMARY OF THE INVENTION

The present invention includes a system and method useful for unloading CNG that has been transported at high pressure, such as from about 3000 to about 4200 PSI, and preferably from about 3250 to about 3600 PSI, and for delivering it to an industrial user at a temperature and pressure falling within a range specified by the user. In one embodiment of the invention, the subject system comprises a series of automated flow control valves through which the offloaded CNG flows to lower the gas pressure and through a plurality of heat exchangers, some of which are disposed between the automated flow control valves, to raise the temperature of the lower-pressure gas at intermediate stages and at the outlet. A recirculating liquid heat exchange medium is desirably provided as part of the system to reheat the offloaded gas as it pumped through the heat exchangers in a direction that is countercurrent to the flow of gas. The flow control valves, at least one heater for the heat exchange medium, and a recirculating pump for the heat exchange medium are desirably electronically linked to and controlled by a pre-programmed or programmable device to achieve acceptable gas flow rates, a predetermined gas outlet temperature, and acceptable pressure levels for both the delivered gas (the "delivery pressure") and the gas retained in the transport vessel (sometimes referred to as the "abandonment pressure"). More particularly, the sensed temperature of the flowing outlet gas downstream of the last heat exchanger is desirably used to control the temperature of the recirculating heat exchange medium to achieve a desired gas outlet temperature.

As used in this specification, the term "automated flow control valves" is intended to extend to and include devices sometimes referred to in the industry as "regulators," "regulator valves," "J/T" or "Joule-Thompson valves" that are preferably gas operated and are actuated in response to gas pressures sensed downstream of the valves to selectively open or restrict the cross-sectional area of the fluid flow path provided by the orifice in the valve. When used to control the flow rate of a fluid flow primarily comprising CNG within the operating ranges disclosed in this specification, the automated flow control valves progressively lower the pressure of the CNG passing through the valves, causing the temperature to fall as well. Because the CNG temperature drops when it undergoes successive pressure drops from the transport pressure down to the delivery discharge pressure (or "outlet pressure"), a plurality of heat exchangers disposed between successive flow control valves can be used to reheat the unloaded gas to a satisfactory delivery temperature. A heat source for the liquid heat exchange medium and at least one recirculation pump are desirably provided to move the heat exchange medium through the recirculation loop.

The CNG unloading system and method disclosed here are desirably configured and automated to unload high pressure natural gas received from a CNG transport such as a tube trailer, gas transport module or gas transport container and to deliver the gas to a customer within specified ranges for delivery pressure and temperature. Gas transport containers suitable for use in conjunction with the subject system and method can be mounted, for example, on a semi-trailer or rail car and will typically contain natural gas compressed to pressures ranging from about 3000 PSI up to about 4200 PSI or higher during transport, with pressures ranging from about 3250 to about 3600 PSI being typical for such uses. Off-loading of the gas desirably continues until the individual gas tubes are emptied to a residual gas pressure of about 100 PSI or lower.

The subject invention is particularly useful in a dynamic environment in which the inlet flow rates and upstream pressure from the transport are constantly decreasing, but in which the temperature and pressure at which the depressurized gas is discharged from the system must be sustained. Once the desired delivery pressure and temperature are set, flow controls can automatically "trim" the stems in the flow control valves in response to the sensed downstream pressures to adjust the flow rates as needed to control the line pressure in the delivery system. Similarly, other flow controls can automatically adjust the temperature and flow rate of the recirculating liquid heat exchange medium so as to deliver the outlet gas discharged from the inventive system at a desired temperature. According to one embodiment of the invention, a buffer tank is also provided as part of the system and is disposed in fluid communication with the fluid flow lines for use in balancing pressures and flow rates between successive flow control valves and heat exchangers in the system, particularly in response to a "throttle slam" (such as an engine fuel demand change from idle to full throttle or vice versa) that can occur while a flow control valve is responding to a sensed pressure and a substantial change in delivery flow volume. In such cases, a buffer tank having a volume sufficient to contain from about a 15-second to about a 60-second supply of gas is typically sufficient to accommodate and compensate for such an event while the valve control reacts to the change in downstream pressure during the unloading process.

In another embodiment of the invention, a natural gas pressure reduction system of the invention is configured as a skid mounted unit that can be conveniently delivered and installed at a preferred, possibly temporary location, quickly put into service, and then relocated to another use site when desired. Such a skid-mounted unit is desirably located at or nearby a CNG unloading site and comprises heat exchangers, automated flow control valves, a heat exchange medium and recirculation system, a heat source for the recirculated heat exchange medium, piping, instrumentation and controls needed to receive highly pressurized CNG from a transport tank and discharge it into the receiving lines of an industrial user. The automated flow control valves desirably include stem-guided, high pressure control valves (as marketed, for example, by Kimray Inc.). Such valves are automated in that they are "self-trimming" in response to the sensed downstream pressure. A digital control system, preferably including a programmable logic controller ("PLC") or functional equivalent, is desirably provided to regulate the flow rate and temperature of the heat exchange medium within the heat exchange recirculation system of the invention by controlling operation of a heater and recirculation pump. The subject system differs from prior closed-loop regulators in that the heat source desirably utilizes the same gas being unloaded to reheat gas that has undergone the pressure drop and associated cooling upon being discharged from the transport. Collectively, the automated flow control valves and the heat exchange medium recirculation system are desirably configured to enable the system to achieve lower residual gas pressures ("abandonment pressures") in the gas transport, thereby improving the efficiency of the gas transport and delivery process.

BRIEF DESCRIPTION OF THE DRAWINGS

The system and method of the invention are further described and explained in relation to the following drawings wherein:

FIG. 1 is a simplified diagrammatic view of one embodiment of the apparatus of the subject system and is also illustrates an embodiment of the inventive method of the invention that is practiced when using the subject apparatus.

DESCRIPTION OF THE PREFERRED EMBODIMENTS

System 10 and the method of the invention are further disclosed in relation to FIG. 1 of the drawings. Compressed natural gas ("CNG") is received into system 10 through inlet valve 12 in flow line 14 at a transport pressure of about 3000 to about 4200 PSI. Pressure relief valve 88 is disposed between inlet valve 12 and heat exchanger 16 to protect system 10 from any gas source in which the gas pressure exceeds the maximum operational pressure for which system 10 is designed, such as, for example, about 4500 PSI. Heat exchanger 16 is desirably a shell and tube heat exchanger designed for use at pressures exceeding the operational pressures disclosed above.

The CNG is desirably heated to about 105° F. in heat exchanger 16 and, upon exiting the heat exchanger, passes through flow lines 18, 24 and valves 20, 26 to be throttled from the inlet pressure to an intermediate pressure of 300 PSI in one or more automated flow control valves 22, 28. The number of throttle valves is determined by the maximum required flow rate measured in standard cubic feet per minute or hour and the lowest operational pressure of the outlet or delivery pressure. At a very high initial transport pressure and at low or "idle" flow rate the throttle valve trim is very small. As the transport gas pressure drops, the flowing gas density drops proportionally and the valve trim or effective orifice diameter must increase to allow for greater flow. As the transport pressure drops, the trim or orifice of first automated flow control valve 22 reaches a maximum open position and the first throttle valve is unable to flow additional volume at the upstream and downstream pressure differential. At this point, automated flow control valve 28 throttle valve begins to open and adds to the max flow rate through automated flow control valve 22. The percent of opening of the orifice in automated flow control valve 28 is adjusted automatically by sensing the downstream pressure and moving the diaphragm and stem of flow control valve 28, thereby either increasing or decreasing the effective temperature due to the Joule Thompson cooling of an expanding gas.

Flow control valves 22, 28 are desirably configured (such as by the use of different orifices and stems, or by the use of other similarly effective components) with different trim levels that are inversely proportional to the preset cracking pressures. When so configured, a flow control valve 22 with a higher preset cracking pressure will desirably have a finer trim (crack open to a lesser extent) than a flow control valve 28 having a lower preset cracking pressure. For example, where the trim level of flow control valve 22 is ⅛ inch and the preset cracking pressure is set at 350 PSI, a representative trim level of flow control valve 28 is ½ inch and the preset cracking pressure of flow control valve 28 is at a lower value, such as about 325 PSI. The trim level and preset cracking pressure of a flow control valve to be used in a particular service within the system of the invention can be specified, reconfigured or adjusted as needed in relation to the inlet pressure and flow rate of the CNG.

The gas flow as apportioned by automated flow control valves 22, 28, is then directed past pressure safety valve 90 and conventional temperature and pressure sensors by flow lines 30, 32 and enters a second set of shell and tube heat exchangers 34, 36. The length and diameter of heat exchangers 34, 36 is desirably determined by the residence time required to reheat the flowing gas based on the maximum gas flow capacity measured in pounds of flowing gas per hour.

The flowing gas is heated to about 105° F. in heat exchangers 34, 36, and the gas exiting heat exchangers 34, 36 through flow lines 38 requires at least one more throttle to further drop the pressure of the flowing gas to its design outlet or discharge pressure (the pressure at which the gas can typically be delivered to an industrial user). Because the first throttling valve, automated flow control valve 22, senses the downstream pressure to adjust its percent of orifice opening, the next throttle valve, automated flow control valve 40, will be adversely affected by changes in the upstream pressure as a result of the pressure drop across the upstream valves 22, 28. This can cause potential feedback or "hunt" oscillations as the control system seeks to determine an effective percent of orifice opening. A large volume buffer such as buffer vessel 46 can be used to compensate for "throttle slams" and reduce and slow the changes in downstream pressure in automated flow control valve 40, allowing the valves trim time to adjust the percent of open in the trim orifice and the control valve. The volume of buffer vessel 46 is desirably sufficient to provide from about a 15 second to about a 60 second flow of gas to maintain the gas flow rate as flow control valves 22, 28 respond to sensed line pressures. Valve 42 and pressure relief valve 92 are desirably provided in flow line 44 to facilitate control and protect the system.

Although only one automated flow control valve 40 is depicted in FIG. 1 for use between heat exchangers 34, 36 and 48, it should be appreciated by those of ordinary skill in the art upon reading this disclosure one or more valves operating similarly to automated flow control valves 22, 28 may be required to drop the pressure of the flowing gas to a level that is consistent with the predetermined delivery pressure and the maximum flow rate.

After the pressure of the flowing CNG has been further reduced by one or more automated flow control valves 40, the flowing CNG is then desirably reheated to the predetermined final gas temperature. System 10 of the invention preferably comprises a heat exchange medium recirculation system comprising at least one heater such as gas-fired heater 62 and an optional supplemental heater 70, preferably including an inline electrical heater, at least one fluid recirculation pump 72, valves 64, 75, 76, flow lines 60, 74, 78, 80, 82, 84, controller 86, and other instrumentation as may be desired by those of ordinary skill in the art. It will be noted, for example, that temperature and pressure gauges are noted at various positions in FIG. 1 that are not specifically identified by reference numerals but are well known to those of skill in the art, who will be familiar with seeing them on piping and instrumentation drawings of this type. On the shell side of each heat exchanger 16, 34, 36 and 48, flow lines 78, 80, 82, 84, 60 are provided (conventional connections not shown) for use in recirculating a contained heated heat exchange medium through each of the heat exchangers in a direction that is countercurrent to the direction of the CNG flow.

A thermocouple disposed near the tube-side outlet of heat exchanger 48 measures the gas temperature as it exits heat exchanger 48. The thermocouple desirably reports the exit temperature of the low pressure gas downstream of heat exchanger 48 to controller 86 that is desirably linked, together with automated flow control valves 22, 28, 40 and the various other temperature and pressure sensors shown in FIG. 1, to a programmable logic controller ("PLC") 96 or other similarly effective controller that is either resident in or communicatively linked to other control elements of system 10 and is preprogrammed to monitor and adjust the settings of all automated devices in system 10 as discussed herein to achieve the intermediate pressures, temperatures and flow rates required to reduce the pressure of the inlet CNG to the predetermined gas delivery pressure and to reheat the pressurized gas to a desirable predetermined temperature.

A preferred heat exchange medium for use in the shell and tube heat exchangers disclosed herein is a glycol water mix, typically a 50/50 mix of ethylene glycol and water. The heated glycol water mix is desirably circulated in a closed loop by an electrically driven centrifugal pump 72. An inline natural gas fired glycol heater is used to supply the majority if not all the heat to the glycol water mix. The natural gas fuel for the in line glycol heater is sourced from the natural gas stream exiting the system through gas flow line 50. A minor portion of the gas flow is desirably diverted through line 54, valve 56 and automated flow control valve 58 to supply fuel gas at an even lower pressure such as about 3 to 10 inches of water column (0.25-0.36 PSI) to heater 62, thereby using a very small percentage of the delivered gas to reheat the offloaded gas as the gas pressure is reduced during the unloading process.

In the embodiment depicted in FIG. 1, the heat output of secondary heater 70, preferably electric powered, can be adjusted by controller 86 or by PLC 96 to increase or decrease the wattage of electricity or BTU's of gas burned in heaters 70, 62, respectively, to heat the heat exchange medium contained in the closed loop recirculation system sufficiently to reheat the recirculating heat exchange medium to a desired temperature.

The in line electrical heater is controlled by a thermostat sensing the final gas temperature. The thermostat varies the wattage in the electrical heating element, thereby increasing or decreasing the final gas temperature to achieve the desired or selected flowing gas temperature. Where very fine control of the final gas temperature is required, such as plus or minus 1° F., the fast response time of the inline electrical heater is used. In some applications where final gas temperature has a broad range, the electrical heater can be eliminated.

The thermocouple is desirably communicatively linked to a PLC 96 or a process control thermostat that pulses or varies the wattage powering the inline electric heater. (In a conventional process control the heater would measure the temperature of the glycol water mix and vary the wattage to maintain a preset fluid temperature similar to a hot tub thermostat control circuit. The distinction here is the thermostat is reading the flowing gas temperature and then varying the wattage to control the gas temperature not the glycol water mix temperature. There is a thermocouple thermostat that interlocks with the power supply to the inline electrical heater that prevents the inline heater from overheating the glycol mix. Should the temperature interlock reach a preset maximum safe glycol temperature, regardless of the final gas flowing temperature, the power is removed from the inline electrical heater.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor and/or Applicant are legally entitled.

What is claimed is:

1. A compressed natural gas unloading system for use in unloading highly pressurized compressed natural gas from a transport vessel, the system comprising gas flow lines enabling fluid communication between at least two automated flow control valves that are spaced apart in a flow direction and cooperate to lower the gas pressure to a predetermined level, at least one heat exchanger and a heat exchange medium recirculation system, wherein at least one heat exchanger is disposed between the at least two spaced-apart automated flow control valves and cooperates with the heat exchange medium recirculation system to heat gas flowing through the compressed natural gas unloading system to a predetermined temperature, wherein a gas flow line disposed between the at least two spaced-apart automated flow control valves is divided into two different flow paths that each pass through a different heat exchanger and are then recombined, and wherein a surge vessel is configured to be selectively placed in fluid communication with the recombined different flow paths.

2. A compressed natural gas unloading system for use in unloading highly pressurized compressed natural gas from a transport vessel, the system comprising gas flow lines enabling fluid communication between at least two automated flow control valves that are spaced apart in a flow direction and cooperate to lower the gas pressure to a predetermined level, at least one heat exchanger and a heat exchange medium recirculation system, wherein at least one heat exchanger is disposed between the at least two spaced-apart automated flow control valves and cooperates with the heat exchange medium recirculation system to heat gas flowing through the compressed natural gas unloading system to a predetermined temperature, wherein the heat exchange medium recirculation system comprises a contained heat exchange medium, at least one heater for the heat exchange medium, at least one pump, and a fluid recirculation loop configured to recirculate the heat exchange medium through the heater, pump and heat exchangers; and wherein the at least one heater is configured to be fueled by a minor portion of lower-pressure gas that is diverted to the at least one heater downstream of the last at least one heat exchanger.

3. The compressed natural gas unloading system of claim 2 wherein the minor portion of lower pressure gas that is diverted to the at least one heater downstream of the last at least one heat exchanger has a flow rate that is controlled by an automated flow control valve installed in a gas flow line to the heater.

* * * * *